US008256603B2

(12) United States Patent
Gauselmann

(10) Patent No.: US 8,256,603 B2
(45) Date of Patent: Sep. 4, 2012

(54) DEVICE FOR INTAKE AND OUTPUT OF PAPER CURRENCY AND METHOD THEREFORE

(75) Inventor: Paul Gauselmann, Espelkamp (DE)

(73) Assignee: adp Gauselmann GmbH, Espelkamp (DE)

( * ) Notice: Subject to any disclaimer, the term of this patent is extended or adjusted under 35 U.S.C. 154(b) by 0 days.

(21) Appl. No.: 12/641,074

(22) Filed: Dec. 17, 2009

(65) Prior Publication Data

US 2010/0181161 A1 Jul. 22, 2010

Related U.S. Application Data

(63) Continuation of application No. 11/780,591, filed on Jul. 20, 2007, now Pat. No. 7,654,442.

(30) Foreign Application Priority Data

Dec. 21, 2006 (DE) ..... 10 2006 060 619

(51) Int. Cl.
*G07F 7/04* (2006.01)
*B65H 39/14* (2006.01)

(52) U.S. Cl. ..... 194/206; 242/528

(58) Field of Classification Search ..... 242/529, 242/533.4; 194/206; 902/9, 11, 12, 13; 235/379; 209/534; 221/71
See application file for complete search history.

(56) References Cited

U.S. PATENT DOCUMENTS

| | | | | |
|---|---|---|---|---|
| 5,876,033 | A | 3/1999 | Lonati | |
| 6,289,261 | B1 * | 9/2001 | Heidel et al. | 700/231 |
| 6,296,242 | B1 * | 10/2001 | Saltsov et al. | 271/3.21 |
| 6,367,692 | B1 | 4/2002 | Junkins et al. | |
| 6,371,473 | B1 * | 4/2002 | Saltsov et al. | 271/3.01 |
| 6,772,870 | B2 * | 8/2004 | Sugai et al. | 194/217 |
| 7,278,527 | B2 * | 10/2007 | Daout et al. | 194/206 |
| 7,344,014 | B2 * | 3/2008 | Takeuchi | 194/207 |
| 7,694,797 | B2 * | 4/2010 | Takeuchi et al. | 194/206 |
| 2001/0022258 | A1 | 9/2001 | Satou et al. | |
| 2005/0056519 | A1 * | 3/2005 | Yokoi et al. | 194/206 |

FOREIGN PATENT DOCUMENTS

| | | | |
|---|---|---|---|
| DE | 198 29 458 | A1 | 1/2000 |
| EP | 0 892 372 | A | 1/1999 |
| EP | 1 220 167 | A | 7/2002 |
| GB | 2 358 509 | A | 7/2001 |
| GB | 2 360 385 | A | 9/2001 |
| WO | PCT/CA99/00165 | | 9/2000 |

* cited by examiner

*Primary Examiner* — Mark Beauchaine
(74) *Attorney, Agent, or Firm* — Henry M. Feiereisen, LLC

(57) ABSTRACT

A device for the intake and output of paper currencies comprises an arrangement for examining the value and authenticity of the currency, which thereafter is fed to a transport system of a currency stacking bank via a currency storage module, wherein the storage module, which is exchangeable located below the currency stacking bank is constructed as a revolving magazine and comprises a series of roller magazines, whereby the intake and output opening of each of the roller magazines is pivoted by means of an actuator into a d position of the transport system.

11 Claims, 2 Drawing Sheets

DEVICE FOR INTAKE AND OUTPUT OF PAPER CURRENCY AND METHOD THEREFORE

CROSS-REFERENCES TO RELATED APPLICATIONS

This application claims the priority of German Patent Application Serial No.: 10 2006 060 619, filed Dec. 21, 2006 pursuant to 35 U.S.C. 119(a)-(d), the subject matter of which is incorporated herein by reference.

BACKGROUND OF THE INVENTION

The present invention relates to a device for depositing and dispensing a paper payment medium and in particular a device for depositing and dispensing paper currency for a machine having a currency validation unit and a storage module.

From DE 198 29 458 A1, a device is known for the storage and dispensation of paper currencies such as bank notes and which comprises in addition to a currency stacking till, a storage drum located beneath the currency stacking till in which the bank notes are rolled around in layers separated by at least one foil strip. Incoming bank notes are sent through a conveyor unit to a verification unit and then to the currency stacking till, respectively the storage drum.

Furthermore, from the WO 00/52649 a device for the deposit and dispensation of bank notes is known. The bank notes are conveyed to a unit with three roller storages. The unit in which the roller magazines are seated can be pivoted into a position for dispensing the bank notes.

The conventional devices that are known for the storage and dispensation of bank notes for the most part are insufficiently compact in their construction. In addition, the bank note storage capacity of such machines is not suitably dimensioned for compactness and efficiency.

It would therefore be desirable and advantageous to provide an improved device for intake and dispensation of currencies to obviate prior art shortcomings and to provide a unit that is compact, easy to install and efficient in use.

SUMMARY OF THE INVENTION

The present invention resolves prior art problems since the device has a compact construction thus permitting that a sufficient amount of the incoming paper currency can be stored in the storage module and that such currency is at any time again available for dispensation in accordance with the determined dispensation schedule.

According to one aspect of the present invention, a device for depositing and dispensing paper payment medium includes a unit for verification of the value of the payment medium and the authenticity of the incoming payment medium, a payment medium storage till for stacking the accepted payment medium such as bank notes and a storage module for the intake and dispensation of the accepted bank notes, as well as a transport unit for conveying the accepted bank notes from the verification unit to the storage till and/or the storage module and wherein the storage module is constructed as a revolving magazine which includes a plurality of roller magazines, each of which is provided with its own opening for entry and exit of bank notes. Each of the roller magazines is pivotable by means of an actuator into a transfer position to an entry and exit opening of the transport system.

In the context of the present invention the terms "paper payment medium", "bank note", "currency", "paper currency" or "bills" are interchangeable terms designating paper or paper like legal tender as payment means.

A further advantageous feature of the device according to the present invention is that the bank note transport unit is separated from the bank note verification unit. A transport unit of the bank note stacking unit is able to deliver the bank notes to the bank note storage modules with a storage capacity for bank notes sorted according to three different bank note face values.

The device is very compact in its construction and requires few additional transport means other than the transport system which is already part of the device. Construction of the device thus provides high storage efficiency in conjunction with simplicity and cost efficiency. In particular, each individual storage roller magazine has a high storage capacity due to the use of only one foil strip for transporting and securing the paper note.

In order to realize both, a secure intake and a secure dispensation of the bank notes, each storage magazine and supply magazine is provided with its own actuating mechanism. These actuating mechanisms are controlled by a common control unit which controls each actuating mechanism according to its individual present function and in turn ensures that the foil strip is under sufficient tension to avoid that the bills can slip from the foil.

Furthermore, the afore-described construction ensures that the bills are always available for dispensation. Also, the device includes that a hand crank is provided inside the housing by means of which the storage modules can be individually manually operated for bill dispensation. Of course, the hand crank is located in a secure location inside the housing which is accessible only to authorized personnel.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
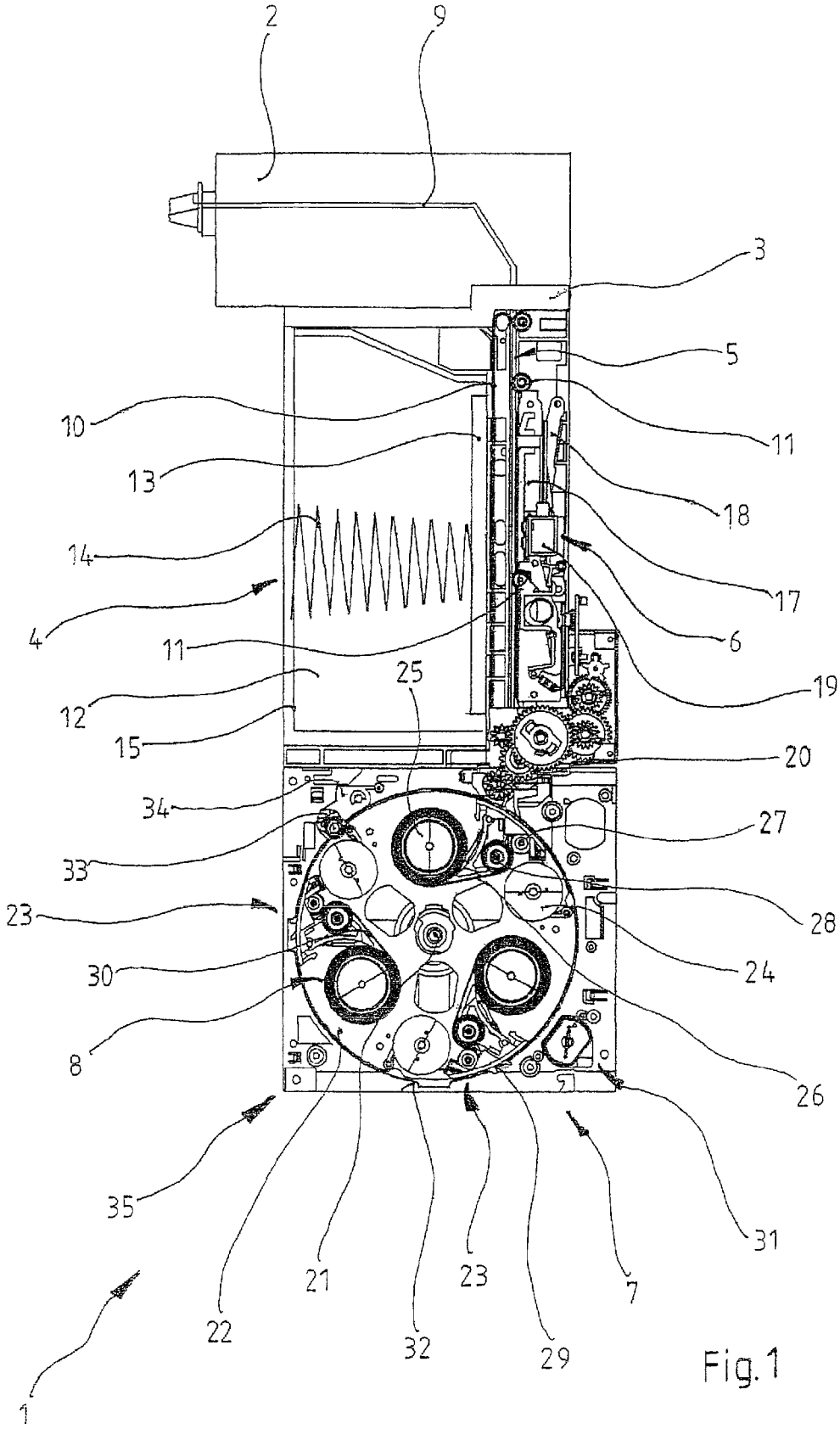
FIG. 1 is a longitudinal section view of the device for the deposit and dispensation of paper currency according to the present invention.

Throughout all the Figures, same or corresponding elements are generally indicated by same reference numerals.

Turning now to the drawings, and in particular to FIG. 1, there is shown a device 1 for the deposit and dispensation of paper currency which includes a paper currency examination unit 2 connected to an attachment plate 3 of a bill stacking unit 4. The bill stacking unit 4 comprises a transport and stacking system 5, 6 which is assigned to a revolving magazine 7. The revolving magazine 7 includes three bill roller magazines 8.

The bill examination unit 2 comprises its own control and transport unit for transporting the accepted bills to a bill dispensing opening 9 of the bill examination unit 2.

The bill dispensation opening 9 is followed by the transport system 5 which consists of two endless bands 10 in parallel disposition to each other and corresponding press rollers 11. Perpendicular to the longitudinal extension of the transport system 5 is the removable bill stacking till 12. The bill stacking till 12 is provided with a spring-loaded stacking floor 13.

With one of its ends, the spring 14 is supported at the stacking floor 13 and with the other end supported at a rear wall 15 of bill collecting till 12. A scissor-type lifting system 17, which is driven by an electromotor is located at the side opposite the stacking floor 13 and corresponds to an access opening (not shown here) to the bill stacking till 12. An accessory drive operatively engages the lifting system 17 thereby causing the lifting system 17 to deflect. A press roller 11 is disposed in a pivotable holding device which is fixed in the area central to the stacking floor 13. An electromagnetic actuator 19 is assigned to the fixed holding device for the press roller 11. The transport system 5 extends to an entry/exit opening 20 of the revolving magazine 7. The revolving magazine 7 is attached in formfitting and/or friction fitting manner at the bottom side of the housing in which the bill stacking unit 4 is situated.

The revolving magazine 7 which comprises at least one face plate 22 is disposed in a housing 35 and is rotatable about a central longitudinal axis 21. Disposed at the face plate 22 are three roller magazines 23 each of which consists of a transport band supply spool 24 and a bill collecting spool 25. A transport band 26 which is coiled about the transport band supply spool 24 is fed to the bill collection spool 25 by means of two deflection rollers 27 that are disposed at the face plate 22. The transport band supply spool 24 and the bill collection spool 25 each comprise its own accessory drive. Each roller magazine 23 is assigned a bill entry and exit opening 29. Deflection rollers 27, 28, bearing transport band 26 are disposed in the area of opening 29. A spring loaded pivotable drag bar 30 is disposed between deflection roller 28 and the bill collection roller 25 and supported by the bill collection spool 25. The drag bar is 30 is mounted at the face plate 22 in a pivotable manner.

The revolving magazine 7 is rotatably disposed at the central longitudinal axis 21. The face place 22 can be swiveled by 240° by means of a motor drive. A motor drive with a swivel gear 31 is operatively engaged with a crown gear of the face plate 22. Each of the bill entry/exit opening 29 of each roller magazine 23 can thus be aligned with the input and output opening 20. At the outer circumference of the face plate 22 there are three spaced apart index notches 32 each of which is correspond to a locking roller 33 with a spring-loaded notch lever 34. A photoelectric barrier is assigned to the notch lever 34 for recognizing the position of the notch lever 34. The photoelectric barrier (not shown here) is connected to a control unit. Each of the roller magazines 23 is provided with its own identical control unit. Data exchange among the control units is carried out by a single-strand data line. The three control units of roller magazines 23 are in correspondence with a control unit of the stacking- and transport system 5, 6.

Figure 2:
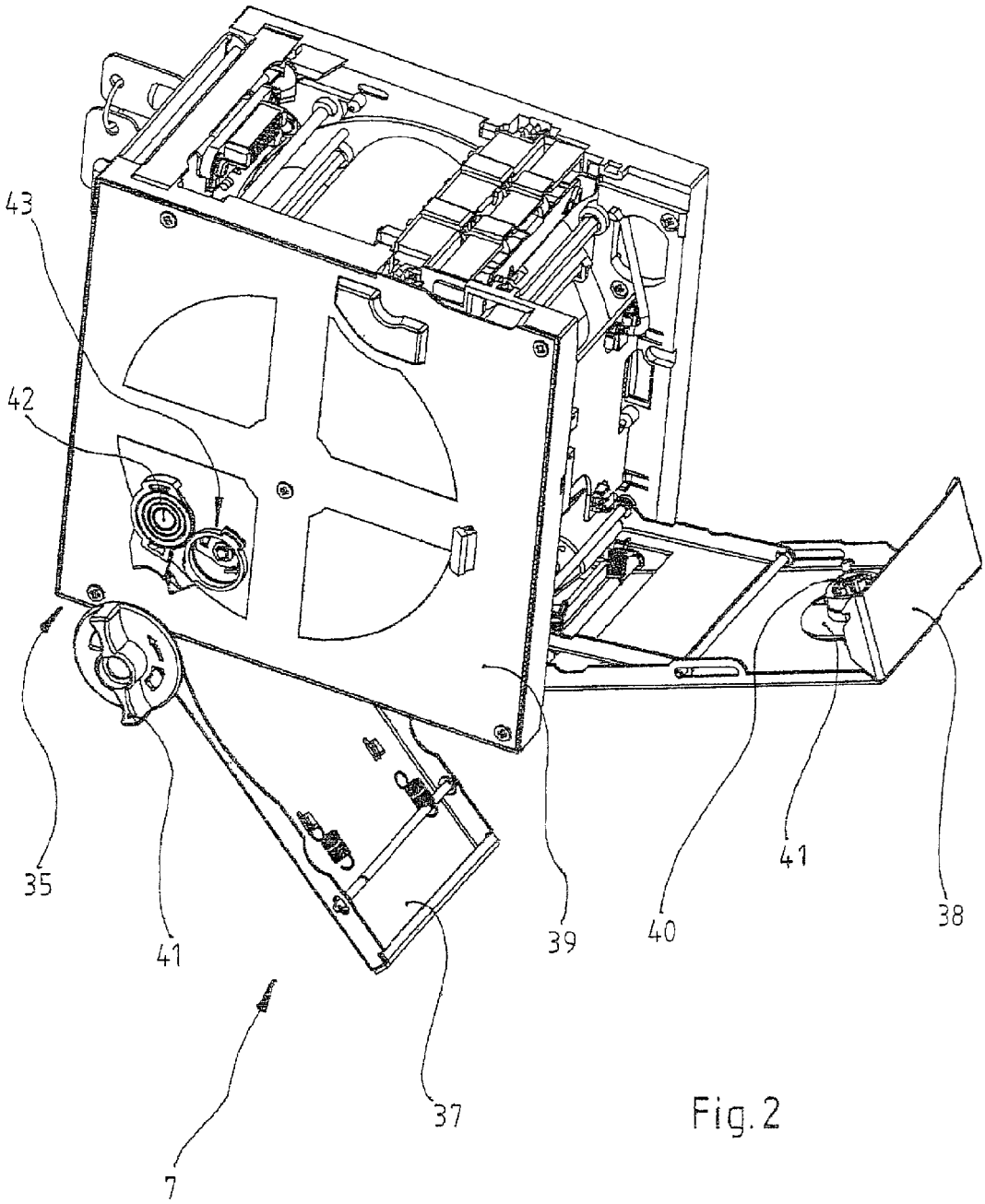
FIG. 2 is perspective view of the device shown in FIG. 1 inside a housing.

The revolving magazine 7 is shown in a perspective view in FIG. 2. The housing 35 of revolving magazine 7 shows service openings with corresponding shutters 37, 38. The housing 35 can be separated from the stacking system 6 by opening a lock with a key. Only after removal of the housing 35 from the stacking system 6, it is possible to open rear shutter 38 and bottom shutter 37. The rear shutter 38 as well as the floor shutter 37 is pivotably disposed at a side wall 39 of the housing 35. On the inner side of rear shutter 38 is a bracket 40 to which a hand crank 41 is form-fittingly attached. The side wall 39 of housing 35 has a cover 42 for locking service opening 43. The axle of the transport band supply spool 24 is located behind the cover 42. A spur gear of the transport band supply spool 24 gearing is connected to the axle of the transport band supply spool 24. At its face, the spur gear has recesses, which correspond with a pin that is fastened at the end of the hand crank 41. The transport band supply spool 24 thus can be manually rotated with the hand crank 41 for winding the transport band up onto the spool 24. By means of the manual operation of the transport band supply spool 24, bills that have been rolled into and stored on the bill collection spool 25 can be dispensed through the bill input/output opening 29 located at the side of the bottom shutter 37. After removal of the hand crank 41 from the service opening 43, the face plate 22 can be pivoted into a next position which permits to insert the hand crank 41 again in order to actuate the transport band supply spool 24 of another roller magazine 23. The face plate 22 can also be pivoted by means of a manual access at the side corresponding to the stacking system 6.

The purposeful pivoting of the face plate 22 ensures that the bill intake and dispensation opening 29 of the respective roller magazine 23 corresponds to the bottom shutter 37 and that the bills which are to be dispensed can be purposefully and securely removed from the revolving magazine 23.

Due to its compactness, device 1 for the deposit and dispensation of bank notes can for example be utilized in coin operated entertainment machines. After the entertainment machine is turned on, device 1 operates under the same electric power source as the entertainment machine.

A bank note is inserted into a deposit opening after which it first moves through a bank note examination unit 2 where it is authenticated and its face value determined. If the bank note is accepted, it is moved via a transport unit of the bank note deposit opening 9 adjoining the examination unit 2, to transport system 5. The transport system 5 moves the bank note to the area of the stacking floor 13. An actuator 19 for the press roller 11 is put into operation so that the press roller 11 is moved in opposite direction of the stacking floor 13. By means of an actuator, the scissor-like lifting system 17 is operated such that the bank note is pressed into the bank note stacking till 12. Thereafter, the actuator of the lifting system 17 is returned to its start position.

After a deposited bank note has been verified and accepted it is then transferred to the transport system 5 and transported along a travel path to the entry/exit opening 20. When reaching the entry/exit opening 20, a light barrier located in the travel path and connected to the control unit of the stacking system 6 is activated and interrupts the transport of the bank note. The determined face value of the bank note which is located in the transport system 5 is then communicated to the control unit of the revolving magazine 7. Depending on the face value of the present bank note, the respective roller magazine 23 is pivoted by means of the actuator 31 on the face plate 22, whereby the bank note intake/output opening 29 of the respective roller magazine 23 will line up with the entry/exit opening 20 of the transport system 5. The recognition of the line-up position is determined by means of the notch lever 34, which locks into an index notch 32 by means of a locking roller 33. Notch lever 34 is assigned a light barrier, which is connected to the control unit of the actuator. After the predetermined line-up position has been reached, the control unit for the roller magazine 23 is activated by the control unit of the bank note stacking unit 4. The control unit of the roller magazine 23 thus activates the actuator of bank note collection spool 25. The bank note is then moved by the transport system 5 into the input/output opening 29 to the point until the light barrier of the roller magazine 23 is activated. The control unit of the roller magazine 23 activates the actuators (not shown) of the transport band supply spool 24 and the bank note collection spool 25, whereby the bank note is now rolled onto the bank note collecting spool 25.

Upon a demand for dispensation of a bank note of a certain face value which is rolled up in the roller magazine 23, the control unit of the bank note stacking unit 4 examines whether the bank note of the demanded face value is available from the roller magazine 23, whose input/output opening 29 is still lined up with the entry/exit opening 20. If the roller magazine 23, currently lined up with the entry/exit opening 20, does not have the bank note of the demanded face value, the actuator 31 of the control unit of the bank note stacking unit 4 becomes activated and continues to be activated until the next respective roller magazine 23 has reached the position where the bank note input/output opening 29 of the respective roller magazine 23 has lined up with the entry/exit opening 20. When the desired locking position is reached, a light barrier is activated by the notch lever 34 thereby stopping the motor followed by the control unit of the bank note stacking unit 4 now activating the control unit of the roller magazine 23 lined up to input entry/exit 20. The control unit of the roller magazine 23 activates the actuator of transport band supply spool 24 and bank note collecting spool 25. When the dispensation position has been reached, that is, when the banknote input/output 29 is aligned with the entry/exit opening 20 of the transport system 5, the control unit of each of the particular roller magazine 23 activates the actuator of each of the transport band supply spool 24 and the bank note collecting spool 25. The bank note is then transported under rejection of the drag bar 30 to the bank note input/output 29 and then transferred into the transport system 5. The outgoing bank note is fed to a bank note examining unit 2 and subsequently dispensed from there.

Since each incoming bank note is registered by the control unit of stacking unit 4, the number and the face value of each bank note is known as well as the sequence of the notes, respectively each individual bank note in each roller magazine 23. This allows bank notes of different face value to be deposited in one roller magazine 23. When a dispensation is forced from the roller magazine 23 carrying bank notes of different face value, the bank notes which physically precede the note to be dispensed is transferred to the transport system 5 and then moved via the stacking system 6 into the stacking till 12.

While the invention has been illustrated and described as embodied in a device for an entertainment machine, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A method for depositing and dispensing paper currency comprising the following steps:

verifying a deposited bank note and determining the face value of the bank note in a verification/examination unit adjacent a first transport unit corresponding to a first travel path transporting the incoming bank note, conveying the bank note via a second transport unit to at least a stacking till or a revolving magazine that includes a plurality of roller magazines;

transporting the bank note along a second travel path to an entry/exit opening adjacent the second transport unit; depending on the face value, the revolving magazine is pivoting into a bank note transfer position so that one of the roller magazines is lining up at an input/output opening with the entry/exit and transferring the bank note to the roller magazine where it is taken up by a dedicated transport system for storage in the roller magazine;

upon a demand for dispensing a certain bank note, a control unit examines whether the lined up roller magazine has the demanded face value and if not, another one of the roller magazines is lining up the input/output opening with the entry/exit; then activating the dedicated transport system to convey the bank note along the second travel path to the second transport unit from where the bank note is conveyed via the first transport path to be examined again by the verification/examination unit before subsequently being released.

2. The method of claim 1, wherein the verified and determined bank note is being conveyed directly into the stacking till without any action by the roller magazine.

3. The method as claimed in claim 1, wherein during the conveying step, communicating the determined face value of the bank note to a control unit of the roller magazine.

4. The method of claim 1, wherein a collecting spool of the roller magazine is filled with bank notes of a single face value.

5. The method as claimed in claim 4, further comprising transferring one or more bank notes from one collection spool to another collection spool of the roller magazine by transferring the bank note by means of the second transport unit.

6. The method as claimed in claim 1, wherein conveying the bank note to the roller magazine includes activating, an actuator for lining up the bank note intake/output opening of the roller magazine with the entry/exit opening of the transport system as determined by a lever assigned a light barrier, wherein a control unit of a bank note stacking unit is activating the control unit for the roller magazine and the roller magazine in turn activates a band supply spool and a bank note collection spool to thereby allow rolling the bank note onto the collection spool.

7. The method of claim 6, further comprising transferring all bank notes from one collecting spool by means of the second transport unit to the stacking till, wherein the empty collecting spool can receive a bank note of another face value.

8. The method of claim 1, wherein the bank note taken up by a bank note collection spool in the roller magazine with adjacent deflection rollers and a transport band supply spool for supplying a transport band to the bank note collection spool and transferring the bank note to the transport band which coils partly about the deflection rollers in the area of the bank note input/output opening.

9. The method of claim 8, further comprising manually rotating the transport band by means of a hand crank for rewinding the transport band to the transport band supply spool so that bills that have been rolled into and stored on the bank note collection spool can be dispensed through a separate bank note input/output opening.

10. The method of claim 9, wherein the hand crank is fastened in form fitting manner by a bracket to an inside surface of a rear shutter of a housing.

11. A method for depositing and dispensing paper currency comprising the following steps:

depositing a bank note for verification and determination of a face value into a bank note examination unit by a first transport unit, conveying the so verified and determined bank note to a second transport unit for conveying the bank note to either a stacking till or a revolving magazine; wherein the revolving magazine which is connected to a face plate includes a plurality of individual roller magazines for uptake and output of bank notes of certain face values, determining the value of the bank note by a light barrier located in a travel path of the bank note and communicating the value to a control unit of the revolving magazine; depending on the face value, one of the roller magazines associated with the bank note face value is pivoting into a predetermined bank note transfer position by lining up an input/output opening of the roller magazine with an entry/exit opening at the second transport unit and transferring the bank note into the roller magazine where the note is taken up by a dedicated transfer system associated with one of the roller magazines;

upon demanding dispensation of the bank note of a specific value, a control unit of the bank note stacking unit is examining whether the bank note of a predetermined face value is available from the lined up roller magazine and if such is not the case, activating the revolving magazine so another one of the roller magazine reaches the line-up position; conveying the bank note by the dedicated transport system to the bank note input/output and transferring it to the second transport unit for conveyance through the examination unit and subsequent dispensation.

* * * * *